420-459 SR
9/16/86 XR 4,612,165

United States Patent [19]

Liu et al.

[11] Patent Number: 4,612,165

[45] Date of Patent: Sep. 16, 1986

[54] DUCTILE ALUMINIDE ALLOYS FOR HIGH TEMPERATURE APPLICATIONS

[75] Inventors: Chain T. Liu, Oak Ridge; James O. Stiegler, Lenoir City, both of Tenn.

[73] Assignee: The United States of America as represented by the United States Department of Energy, Washington, D.C.

[21] Appl. No.: 564,108

[22] Filed: Dec. 21, 1983

[51] Int. Cl.[4] ..... C22C 19/00

[52] U.S. Cl. ..... 420/459; 420/460

[58] Field of Search ..... 420/460, 459; 148/429

[56] References Cited

PUBLICATIONS

Iron Age, Sep. 24, 1982, p. 63.

Aoki et al., Nippon Kinzoku Gakkaishi, vol. 43, No. 12, pp. 1190–1195, 1979.

Fossil Energy Program Quarterly Progress Report, ORNL-5955, p. 40, Jun. 1983.

Tsipas, Proceedings JIMIS-3, 1983.

*Primary Examiner*—R. Dean

*Attorney, Agent, or Firm*—Stephen D. Hamel; Judson R. Hightower

[57] ABSTRACT

Improved $Ni_3Al$ alloys are provided by inclusion of boron, hafnium or zirconium, and in some species, iron.

5 Claims, 2 Drawing Figures

DUCTILE ALUMINIDE ALLOYS FOR HIGH TEMPERATURE APPLICATIONS

This invention, which resulted from a contract with the United States Department of Energy, relates to heat and corrosion resistant alloys containing nickel, aluminum, boron, hafnium or zirconium, and in some species, iron.

Because of the limited availability and strategic nature of chromium, there has been an increasing interest in the development of strong, heat and corrosion resistant alloys for use as substitutes for the many chromium-containing ferrous alloys commonly referred to as stainless steels. Some nickel and iron aluminides have been found to maintain high strength and resist oxidation at elevated temperatures. Although single crystals of $Ni_3Al$ are known to be ductile, polycrystalline forms of the intermetallic compound are extremely brittle and therefore can not be used to form sheetmetal products. However, it has been reported recently by Aoki and Izumi in *Nippon Kinzoku Gakkaishi,* Volume 43, Number 12, that the addition of a small amount of boron can reduce the brittleness of $Ni_3Al$.

U.S. patent application Ser. No. 519,941, filed on Aug. 3, 1983, by Chain T. Liu and Carl C. Koch and assigned to the United States Department of Energy, the assignee of this application, disclosed that the addition of small amounts of manganese, niobium and titanium improves the fabricability of $Ni_3Al$ alloys, and that the addition of about 6.5 to about 16.0 weight percent iron to such alloys inreases their yield strength while reducing the amount of nickel used therein.

SUMMARY OF THE INVENTION

It is therefore, the object of this invention is to provide an improved high strength alloy for use in hostile environments.

Another object of the invention is to provide an alloy which exhibits high strength at temperatures well above 600° C.

A further object of the invention is to provide an alloy which is resistant to oxidation at elevated temperatures, e.g., 1,000° C.

The invention takes on two forms, Type I and Type II, as shown in Tables I and II, respectively. Type I alloy consists of sufficient nickel and aluminum to form $Ni_3Al$, an amount of boron effective to promote ductility in the alloy, and 0.3 to 1.5 at.% of an element selected from the class consisting of hafnium and zirconium. The total concentration of aluminum an hafnium (or zirconium) must be less than 24.5 at.% in order to be fabricable.

The Type II alloy consists of $Ni_3Al$ plus boron for ductility, iron for strength, and hafnium for increased strength at elevated temperature. The type II alloy may be described generally as follows. In an alloy comprising about 19 to 21.5 at.% aluminum, 0.08 to 0.3 at.% boron, 6 to 12 at.% iron, the balance being nickel, the improvement comprising the addition of 0.3 to 1.5 at.% of an element selected from the class consisting of hafnium and zirconium. The total concentration of aluminum and hafnium (or zirconium) must not exceed 22 at.%.

DESCRIPTION OF PREFERRED EMBODIMENTS OF THE INVENTION

Figure 1:
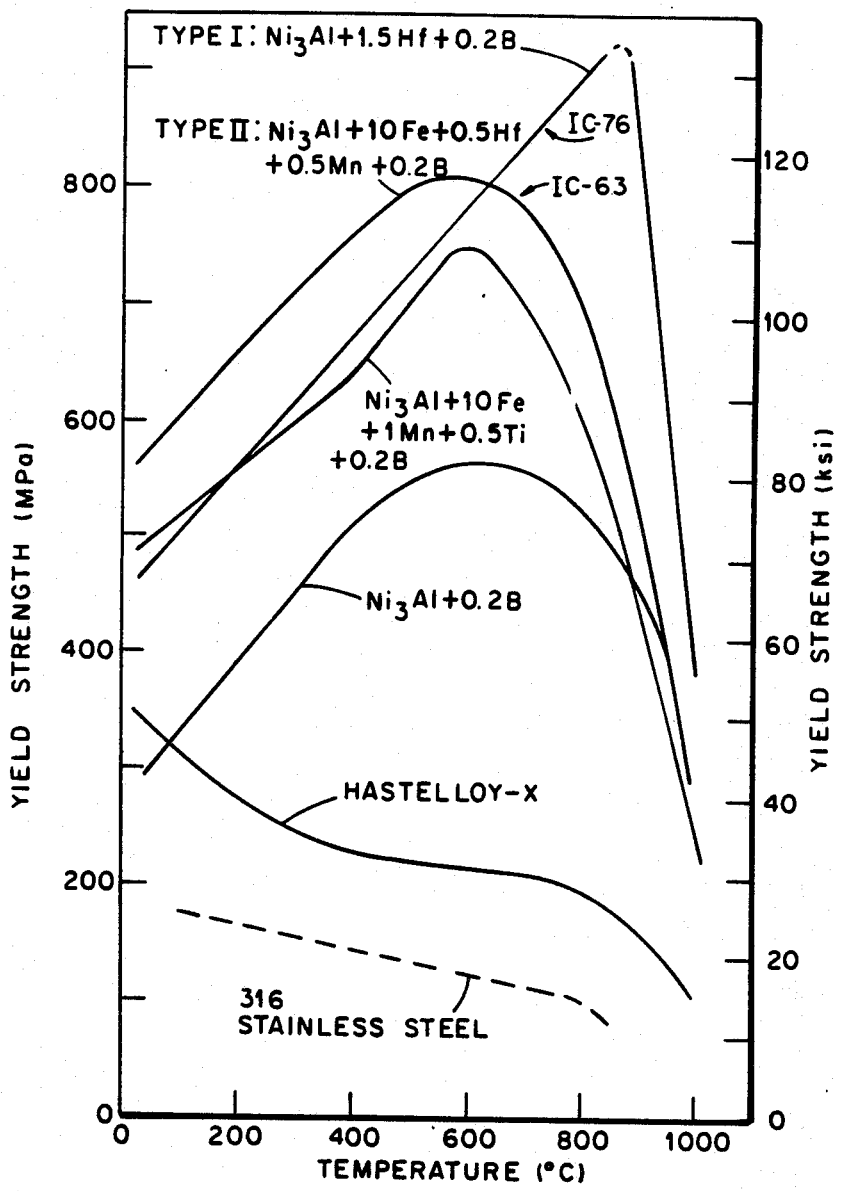
FIG. 1 is a graph showing yield strengths as a function of temperature for previously known commercial alloys and alloys having compositions in accordance with the invention.

Alloys in accordance with the invention can be prepared as described in the following examples.

Aluminide alloys were prepared having the compositions shown in Table I (which compositions will be referring to hereinafter as Type I alloys) and Table II (which compositions will be referred to hereinafter as Type II alloys).

TABLE I

Composition of hafnium-modified nickel aluminides (based on $Ni_3Al$) (Type I Alloys)

| Alloy number | (at. %) | (wt. %) |
|---|---|---|
| IC-15 | Ni—24 Al—0.2 B | Ni—12.7 Al—0.05 B |
| IC-71 | Ni—23.8 Al—0.25 Hf—0.2 B | Ni—12.4 Al—0.9 Hf—0.05 B |
| IC-49 | Ni—24.0 Al—0.5 Hf—0.2 B | Ni—12.5 Al—1.7 Hf—0.05 B |
| IC-50 | Ni—23.5 Al—0.5 Hf—0.2 B | Ni—12.2 Al—1.7 Hf—0.05 B |
| IC-72 | Ni—23.0 Al—1.0 Hf—0.2 B | Ni—11.8 Al—3.4 Hf—0.05 B |
| IC-76 | Ni—22.5 Al—1.5 Hf—0.2 B | Ni—11.4 Al—5.0 Hf—0.05 B |
| IC-77 | Ni—22.0 Al—2.0 Hf—0.2 B | Ni—11.0 Al—6.6 Hf—0.05 B |
| IC-78 | Ni—21.0 Al—3.0 Hf—0.2 B | Ni—10.2 Al—9.6 Hf—0.05 B |

TABLE II

Composition of hafnium-modified nickel aluminides alloyed with iron and other metallic elements (Type II Alloys)

| Alloy number | (at. %) | (wt. %) |
|---|---|---|
| IC-63 | Ni—20 Al—10 Fe—0.5 Hf—0.5 Mn—0.2 B | Ni—10.2 Al—10.6 Fe—1.7 Hf—0.5 Mn—0.05 B |
| IC-68 | Ni—20 Al—9.1 Fe—0.5 Hf—0.5 Ta—0.5 Mn—0.1 B | Ni—10.1 Al—9.5 Fe—1.7 Hf—1.7 Ta—0.5 Mn—0.025 B |
| IC-69 | Ni—20 Al—9.1 Fe—0.5 Hf—0.5 Nb—0.5 Mn—0.1 B | Ni—10.2 Al—9.6 Fe—1.7 Hf—0.9 Nb—0.5 Mn—0.025 B |
| IC-101 | Ni—19.5 Al—9.0 Fe—1.0 Hf—0.1 B | Ni—9.8 Al—9.4 Fe—3.3 Hf—0.02 B |

Control samples of boron-doped $Ni_3Al$ alloys were prepared for comparison to the subject improved alloys. The alloys were prepared by arc melting and drop casting pure aluminum, iron (when desired), hafnium, and a master alloy of nickel-4 wt.% B, in proportions which provided the alloy compositions listed in the tables.

The alloy ingots, thus prepared, were homogenized at 1,000° C. and fabricated by repeated cold rolling with intermediate anneals at 1,050° C. All the Type I alloys were successfully cold rolled into 0.76 mm-thick sheet except the 3.0 at.% Hf alloy (IC-78) which cracked during early stages of fabrication. Table III shows the effect of alloy stoichiometry on fabrication of nickel aluminides modified with 0.5 at.% Hf (1.7 wt.% Hf).

TABLE III

Composition and Fabricability of Hafnium-Modified Nickel Aluminides (based on $Ni_3Al$) Containing 0.5 at. % Hf (1.7 wt. % Hf)

| Alloy Number | Composition (at. %) | Composition (wt. %) | Fabrication |
|---|---|---|---|
| IC-48 | Ni—24.5 Al—0.5 Hf—0.2 B | Ni—12.8 Al—1.7 Hf—0.05 B | Ingot cracked during fabrication |
| IC-49 | Ni—24.0 Al—0.5 Hf—0.2 B | Ni—12.5 Al—1.7 Hf—0.05 B | Sheet fabricated with difficulty |
| IC-50 | Ni—23.5 Al—0.5 Hf—0.2 B | Ni—12.2 Al—1.7 Hf—0.05 B | Sheet fabricated |

The results in Table II indicate that the sheet fabrication becomes increasingly difficult as the total Al and Hf content increases, and that the aluminide with a total of 25 at.% Al and Hf can not be sucessfully fabricated by cold rolling. Thus, the total concentration of Al and Hf in the Type I aluminide alloys should be less than 24.5 at.%.

The tensile properties of the hafnium-modified aluminide alloys were determined as a function of test temperature in vacuum. Table IV shows the effect of hafnium additions tensile properties of the Type I aluminide alloys tested at 850° C.

TABLE IV

Effect of hafnium additions on tensile properties of boron-doped $Ni_3Al$ tested at 850° C.

| Hf concentration (at. %) | Yield Strength MPa | Yield Strength (ksi) | Tensile Strength MPa | Tensile Strength (ksi) | Elongation (%) |
|---|---|---|---|---|---|
| 0 | 498 | (72.3) | 660.1 | (95.8) | 7.1 |
| 0.25 | 548 | (79.5) | 692.5 | (100.5) | 3.1 |
| 0.50 | 640.1 | (92.9) | 866.1 | (125.7) | 14.1 |
| 1.0 | 744.1 | (108.0) | 926.0 | (134.4) | 5.5 |
| 1.5 | 922.6 | (133.9) | 1085.9 | (157.6) | 9.6 |
| 2.0 | 788.9 | (114.5) | 788.9 | (114.5) | <0.1 |

Both tensile and yield strengths increase with hafnium content and peak at about 1.5 at.% Hf. At hafnium contents less than about 0.3 at.% Hf, the effect becomes insignificant while at Hf contents above 1.5 at.% Hf, the beneficial effect drops off and the alloy can not be fabricated at 3 at.% Hf. Note that the aluminide containing 1.5 at.% Hf has a yield strength of 923 MPa (134 ksi) and an ultimate tensile strength of 1086 MPa (158 ksi), properties which are higher than those of commercial superalloys including cast alloys.

The yield strength of boron doped $Ni_3Al$ and hafnium-modified, boron doped $Ni_3Al$ (1.5 at.% Hf) is plotted as a function of temperature in FIG. 1 (specimen IC-76). For comparison, the strength of commercial solid-solution alloys, such as Hastelloy X and type 316 stainless steel, is also included in the plot. Unlike the conventional solid-solution alloys, the yield strength of the boron doped $Ni_3Al$ increases as the temperature rises and reaches a maximum at about 600° C. Previously, macroalloying of $Ni_3Al$ showed that alloy elements only increase the strength level but did not raise the peak temperature for the maximum strength. The unique feature of alloying with selected amounts of hafnium is that the peak temperature is extended from about 600° C. to around 850° C. This breakthrough in the development of alloys for high temperature use.

Specimens of the Type II hafnium-modified aluminide, alloyed with 9 to 10 at.% Fe, were fabricated into 0.8 mm thick sheets by repeated cold rolling described in the Example. Tensile properties of the IC-63 alloy are plotted in FIG. 1 along with results obtained for several other alloys. It can be seen in FIG. 1 that IC-63 has the best yield strength at temperatures below 650° C., while IC-76 exhibits the highest yield strength above 650° C. Type II alloys containing increased quantities of hafnium have even better strength at elevated temperature.

Figure 2:
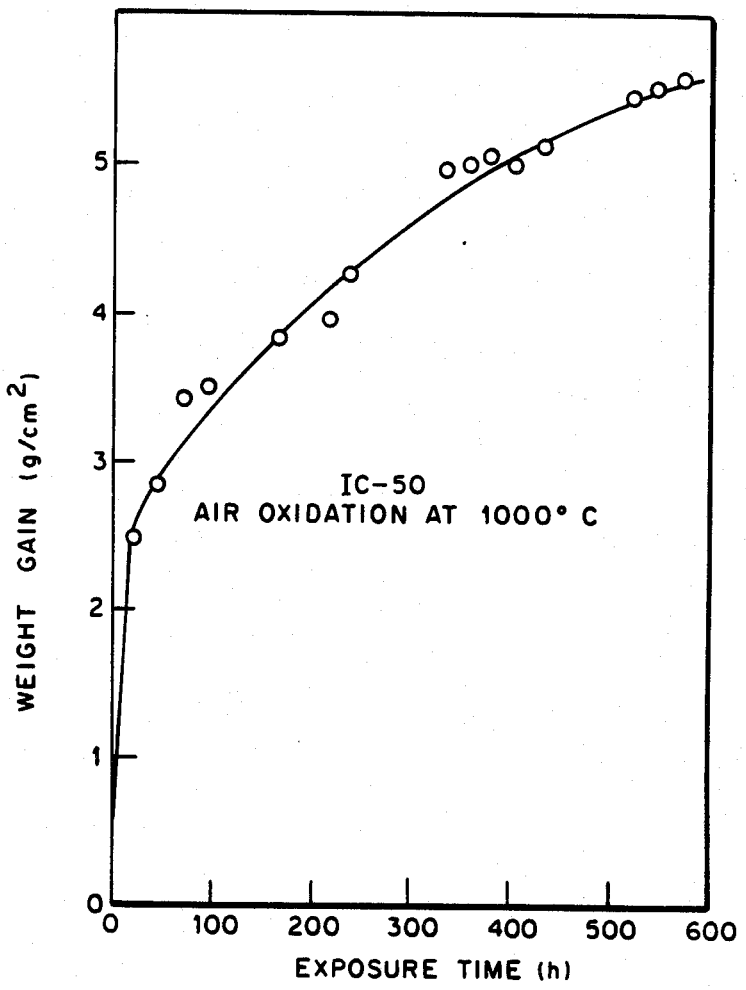
FIG. 2 is a graph showing weight gain due to oxidation, as a function of time, of an alloy having a composition in accordance with the invention.

To demonstrate the oxidation resistance of the subject alloys, specimens IC-49 and IC-50 were studied by furnacing at 1,000° C. in air. The samples were removed from the furnace after each 25 to 75 h exposure. FIG. 2 is a plot of weight gain due to oxidation of specimen IC-50 as a function of exposure time at 1,000° C. Examination of the hafnium-modified aluminide showed no apparent spalling. The total weight gain of 0.6 mg/cm$^2$ after 571 h exposure is much lower than that exhibited by stainless steels and commercial superalloys.

Other elements from group IVA of the periodic table have also been alloyed with boron doped $Ni_3Al$ intermetallic alloys. Zirconium showed some improvement in the high temperature properties of aluminides but was not as effective as hafnium. Titanium additions did not appear to improve the mechanical properties. Table IV shows the tensile properties of boron doped nickel aluminides containing 0.5 at.% of Hf, Zr or Ti.

TABLE IV

Tensile properties of boron doped nickel aluminides alloyed with 0.5 at. % Hf, Zr, or Ti (tests at 850° C.)

| Alloy addition | Yield strength (ksi) | Tensile strength (ksi) | Elongation (%) |
|---|---|---|---|
| O | 72.3 | 95.8 | 7.1 |
| Hf | 92.9 | 125.7 | 14.1 |
| Zr | 83.6 | 83.6 | 0.2 |
| Ti | 65.6 | 72.6 | 1.0 |

Creep properties of Hf-, Zr-, and Ti-modified aluminides along with selected commercial solid-solution alloys are shown in Table V.

TABLE V

Creep properties of Hf-, Zr-, and Ti-modified aluminides and commercial solid-solution alloys [All materials were tested at 760° C. and 20,000 psi (138 MPa)]

| Alloy composition[a] (at. %) | Steady state creep Rate ($10^{-6}$/h) | Rupture life (h) |
|---|---|---|
| $Ni_3Al$ | 91.0 | 352 |
| $Ni_3Al$ + 0.25 Hf | 31.0 | >>599[b] |
| $Ni_3Al$ + 0.5 Hf | 3.3 | >>580[b] |
| $Ni_3Al$ + 0.5 Zr | 8.1 | >>507[b] |
| $Ni_3Al$ + 1.0 Hf | 4.3 | >>596[b] |
| $Ni_3Al$ + 1.0 Ti | 17.1 | >503[b] |
| $Ni_3Al$ + 1.5 Hf | 3.7 | >>480[b] |
| $Ni_3Al$ + 2.0 Hf | 0.5 | >>480[b] |
| Type 316 stainless steel | 8540.0 | 65 |
| Hastelloy X | 1320.0 | 252 |

[a]All aluminides were doped with 0.2 at. % B.
[b]Tests discontinued without rupture.

The data in Table V show that alloying with Hf and Zr greatly lowers the steady state creep rate and extends the rupture life of $Ni_3Al$ alloys.

We claim:

1. An alloy consisting essentially of sufficient nickel and aluminum to form $Ni_3Al$, an amount of boron sufficient to promote ductility in the alloy and 0.3 to 1.5 atomic percent of an element selected from the group consisting of hafnium and zirconium.

2. The alloy of claim 1 further including 6 to 12 atomic percent iron.

3. The alloy of claim 2 comprising about 19 to about 21.5 atomic percent aluminum and about 0.08 to about 0.3 atomic percent boron.

4. The alloy of claim 1 wherein the total concentration of aluminum and the element selected from said group is less than 24.5 atomic percent.

5. The alloy of claim 2 wherein the total concentration of aluminum and the element selected from said group is 22 atomic percent or less.

* * * * *

REEXAMINATION CERTIFICATE (1515th)

United States Patent [19] [11] B1 4,612,165

Liu et al. [45] Certificate Issued Jul. 23, 1991

[54] DUCTILE ALUMINIDE ALLOYS FOR HIGH TEMPERATURE APPLICATIONS

[75] Inventors: Chain T. Liu, Oak Ridge; James O. Stiegler, Lenoir City, both of Tenn.

[73] Assignee: The United States of America as represented by the United States Department of Energy, Washington, D.C.

Reexamination Request:
No. 90/001,211, Apr. 8, 1987

Reexamination Certificate for:
Patent No.: 4,612,165

Issued: Sep. 16, 1986
Appl. No.: 564,108
Filed: Dec. 21, 1983

[51] Int. Cl.[5] ..... C22C 19/00
[52] U.S. Cl. ..... 420/459; 420/460
[58] Field of Search ..... 420/459, 460; 148/429

[56] References Cited

FOREIGN PATENT DOCUMENTS 2037322A 7/1980 United Kingdom .

*Primary Examiner*—Richard O. Dean

[57] ABSTRACT

Improved $Ni_3Al$ alloys are provided by inclusion of boron, hafnium or zirconium, and in some species, iron.

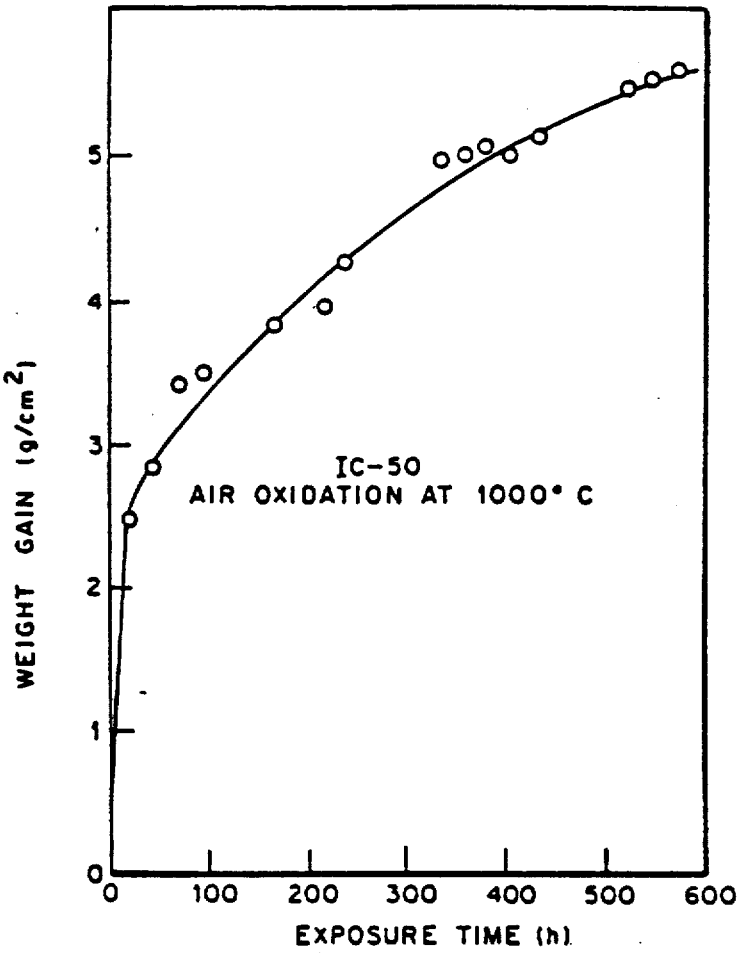

Fig. 2

REEXAMINATION CERTIFICATE ISSUED UNDER 35 U.S.C. 307

THE PATENT IS HEREBY AMENDED AS INDICATED BELOW.

Matter enclosed in heavy brackets [ ] appeared in the patent, but has been deleted and is no longer a part of the patent; matter printed in italics indicates additions made to the patent.

AS A RESULT OF REEXAMINATION, IT HAS BEEN DETERMINED THAT:

Claims 1 and 4 are cancelled.

Claim 2 is determined to be patentable as amended.

Claims 3 and 5, dependent on an amended claim, are determined to be patentable.

New claim 6 is added and determined to be patentable.

2. [The alloy of claim 1 further including] *An alloy consisting essentially of sufficient nickel and aluminum to form $Ni_3Al$, an amount of boron sufficient to promote ductility in the alloy, 0.3 to 1.5 atomic percent of an element elected from the group consisting of hafnium and zirconium, and* 6 to 12 atomic percent iron.

*6. An alloy consisting essentially of sufficient nickel and aluminum to form $Ni_3Al$, about 0.08 to 0.3 atomic percent boron to promote ductility in the alloy and 0.3 to 1.5 atomic percent hafnium to significantly increase high temperature strength and also significantly increase the temperature at which said strength increase occurs in the alloy, the total concentration of aluminum and hafnium being 24.5 atomic percent or less.*

* * * * *